US005718045A

United States Patent [19]

Tsukahara et al.

[11] Patent Number: 5,718,045

[45] Date of Patent: Feb. 17, 1998

[54] SILENCER AND PROCESS FOR PRODUCING THE SAME

[75] Inventors: Takeshi Tsukahara; Takeo Horiike; Makoto Miyake, all of Saitama, Japan

[73] Assignees: Honda Giken Kogyo Kabushiki Kaisha, Tokyo; Yutaka Giken Co., Ltd., Shizuoka; Nakagawa Sangyo Kabushiki Kaisha, Aichi, all of Japan

[21] Appl. No.: 424,688

[22] Filed: Apr. 18, 1995

[30] Foreign Application Priority Data

Apr. 21, 1994 [JP] Japan ..... 6-083127

[51] Int. Cl.[6] ..... B23P 15/00

[52] U.S. Cl. ..... 29/890.08; 181/228

[58] Field of Search ..... 181/227, 228, 181/252, 255, 256, 265, 269, 272, 282; 29/890.08

[56] References Cited

U.S. PATENT DOCUMENTS

| | | | |
|---|---|---|---|
| 4,228,868 | 10/1980 | Raczuk | 181/252 X |
| 4,278,147 | 7/1981 | Watanabe et al. | 181/256 |
| 4,598,790 | 7/1986 | Vesugi et al. | 181/252 |
| 5,036,585 | 8/1991 | Schweinfurth | 29/890.08 |
| 5,260,522 | 11/1993 | Vogt et al. | 181/207 |
| 5,479,706 | 1/1996 | Tamano et al. | 29/890.08 |

FOREIGN PATENT DOCUMENTS

| | | |
|---|---|---|
| 8204025 U | 7/1982 | Germany . |
| 3438789 A1 | 4/1986 | Germany . |
| 2-36885 | 10/1990 | Japan . |

*Primary Examiner*—Khanh Dang
*Attorney, Agent, or Firm*—Lyon & Lyon LLP

[57] ABSTRACT

A silencer includes: a porous inner pipe provided in a peripheral wall thereof with a large number of small pores; an outer pipe surrounding the porous inner pipe; a sound absorbing material incorporated in an annular clearance between the porous inner pipe and the outer pipe; and a plurality of exhaust gas expansion chambers defined in the porous inner pipe and arranged such that an exhaust gas is sequentially passed through the exhaust gas expansion chambers. The sound absorbing material is formed of a heat-resistant fiber layer which is wound around an outer peripheral surface of the porous inner pipe with a binder interposed therebetween, and an outer peripheral surface of the heat-resistant fiber layer is press-fitted to an inner peripheral surface of the outer pipe with a predetermined interference. Thus, it is possible to prevent a reduction in sound vanish effect due to the leakage and short-circuiting of an exhaust gas and a reduction in engine power performance.

2 Claims, 5 Drawing Sheets

3
4
6
6a
8f
9
C1
C2
C3
C4
10f
10m
10r
8a
12
13
14
I
I'
M
7
8
8r
5
4
5
6

SILENCER AND PROCESS FOR PRODUCING THE SAME

BACKGROUND OF THE INVENTION

1. Field of the Invention

The present invention relates to a silencer and a process for producing the silencer of a type including a porous inner pipe having a plurality of exhaust gas expansion cheers defined therein and arranged such that an exhaust gas from an internal combustion engine is sequentially passed through the exhaust gas expansion cheers, and a sound absorbing material incorporated in an annular clearance between the porous inner pipe and an outer pipe which surrounds the porous inner pipe.

2. Description of the Prior Art

The silencer of the above-described type is designed such that the expansion and contraction of the exhaust gas is repeated in the course of sequential passing of the exhaust gas through the plurality of exhaust gas expansion cheers, thereby enhancing the exhaust gas sound vanish effect and satisfying an intended power performance. During this time, the sound absorbing material functions to absorb a noise generated in the course of the repetition of expansion and contraction of the exhaust gas.

There is a known process for producing a silencer of the above-described type as disclosed, for example, in Japanese Utility Model Publication No. 36885/90. The known process includes steps of: molding a heat-resistant fiber layer of glass wool or the like into a cylindrical shape using a mold, making a longitudinal cut (i.e., a cut along an axis) in a molded product which is a sound absorbing material, releasing the molded product from the mold, press-fitting the sound absorbing material to an outer peripheral surface of the porous inner pipe with a predetermined interference, and inserting the sound absorbing material into the outer pipe.

In the known silencer, however, the longitudinal cut in the sound absorbing material may be relatively enlarged due to a manufacture error or a vibration, and an exhaust gas may be leaked through the cut in some cases, thereby bringing about a reduction in sound vanish effect and a reduction in engine power performance.

In addition, a gap may be produced between an outer peripheral surface of the sound absorbing material and the inner peripheral surface of the outer pipe due to a manufacture error, and thus, the exhaust gas may flow through the cut or the inside of the sound absorbing material into such gap in some cases, thereby bringing about a reduction in sound vanish effect and a reduction in engine power performance.

SUMMARY OF THE INVENTION

Accordingly, it is an object of the present invention to provide a silencer capable of effectively avoiding the above-described problems, and a process for producing such a silencer.

To achieve the above object, according to the present invention, there is provided a silencer comprising: a porous inner pipe provided in a peripheral wall thereof with a large number of small pores; an outer pipe surrounding the porous inner pipe; a sound absorbing material incorporated in an annular clearance between the porous inner pipe and the outer pipe; and a plurality of exhaust gas expansion chambers defined in the porous inner pipe and arranged such that an exhaust gas is sequentially passed through the exhaust gas expansion chambers; wherein the sound absorbing material is formed of a heat-resistant fiber layer which is wound around an outer peripheral surface of the porous inner pipe with a binder interposed therebetween, an outer peripheral surface of the heat-resistant fiber layer being press-fitted to an inner peripheral surface of the outer pipe with a predetermined interference.

In addition, according to the present invention, there is also provided a process for producing a silencer comprising: a porous inner pipe provided in a peripheral wall thereof with a large number of small pores; an outer pipe surrounding the porous inner pipe; a sound absorbing material incorporated in an annular clearance between the porous inner pipe and the outer pipe; and a plurality of exhaust gas expansion chambers defined in the porous inner pipe and arranged such that an exhaust gas is sequentially passed through the exhaust gas expansion chambers, the process comprising the steps of: winding a heat-resistant fiber layer with a binder is applied thereto directly around an outer peripheral surface of the porous inner pipe to form a sound absorbing material having an outside diameter larger than an inside diameter of the outer pipe, and press-fitting an inner peripheral surface of the outer pipe to an outer peripheral surface of the sound absorbing material formed in the above step.

With the above-described silencer and method for producing the same, it is not necessary to make a longitudinal cut in the sound absorbing material for releasing the sound absorbing material from the mold, but also it is possible to effectively avoid the generation of a gap between the inner peripheral surface of the outer pipe and the outer peripheral surface of the sound absorbing material. Therefore, it is possible to avoid the leakage and short-circuiting of an exhaust gas through the cut into the gap, thereby enhancing the sound vanish effect of the silencer, while insuring an intended engine power performance.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of a preferred embodiment in connection with the accompanying drawings.

Figure 1:
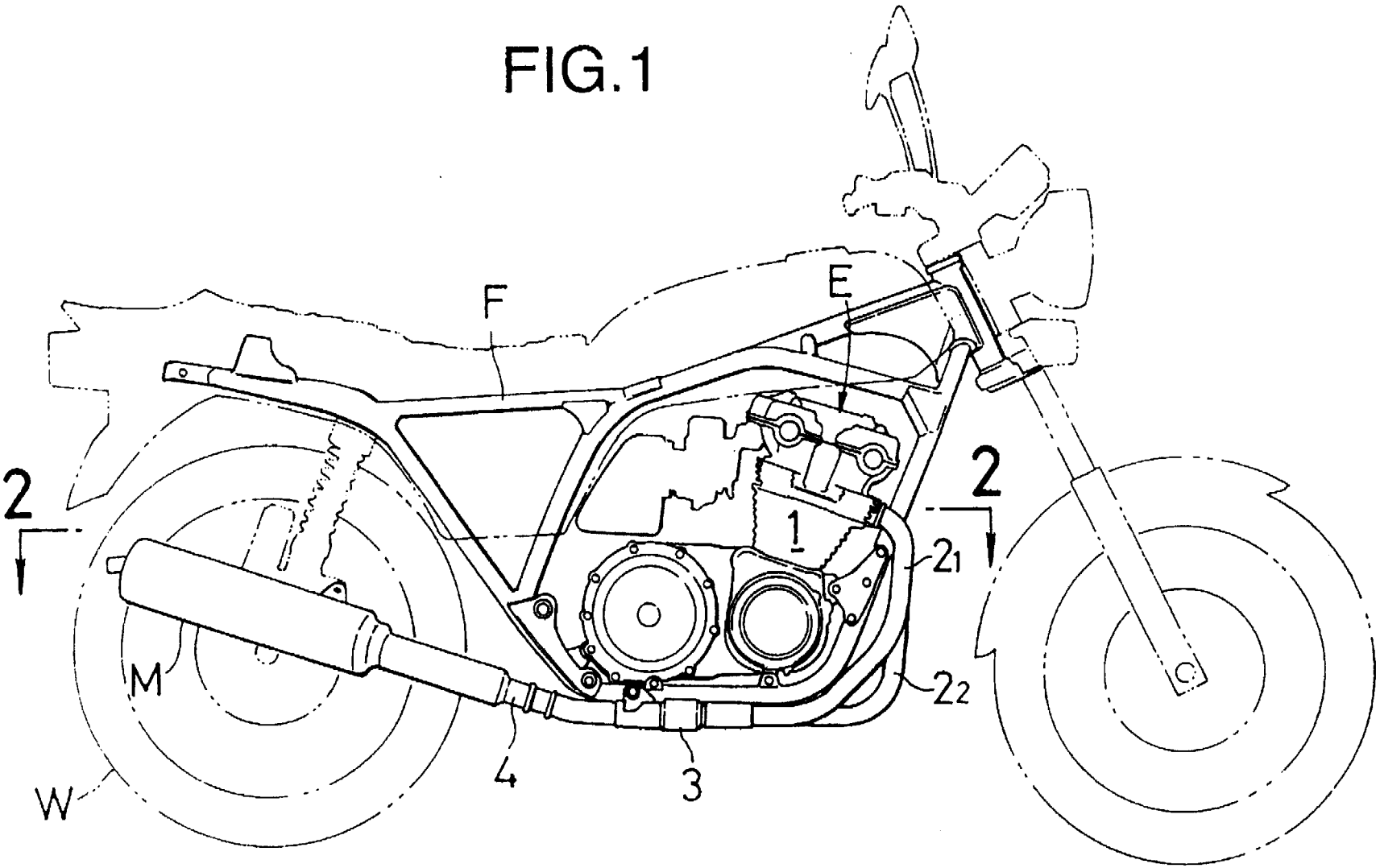
FIG. 1 is a side view of a motorcycle to which an embodiment of the present invention is applied.
Figure 2:
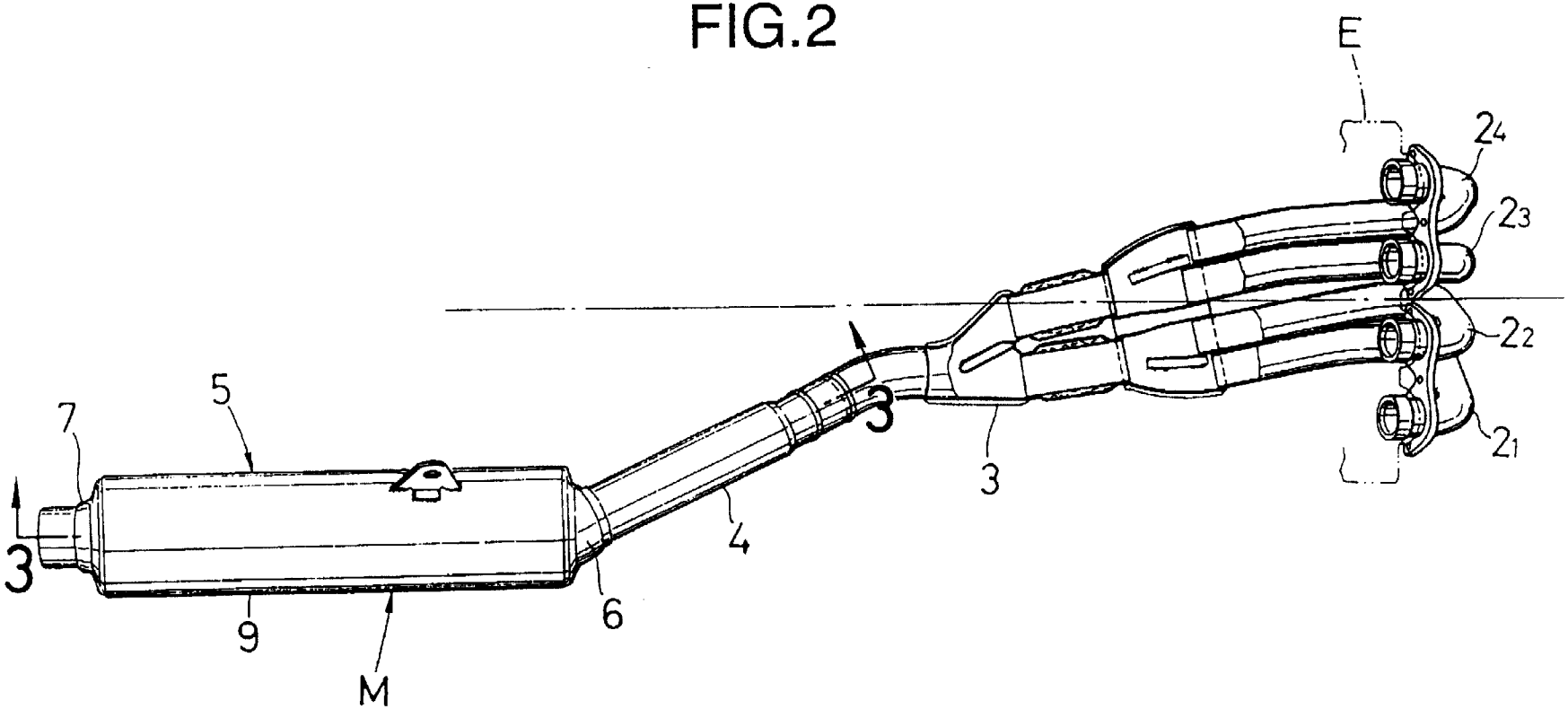
FIG. 2 is an enlarged plan view of an essential portion of an exhaust system in the embodiment (an enlarged view taken along an arrow 2—2 in FIG. 1)
Figures 3, 3A:
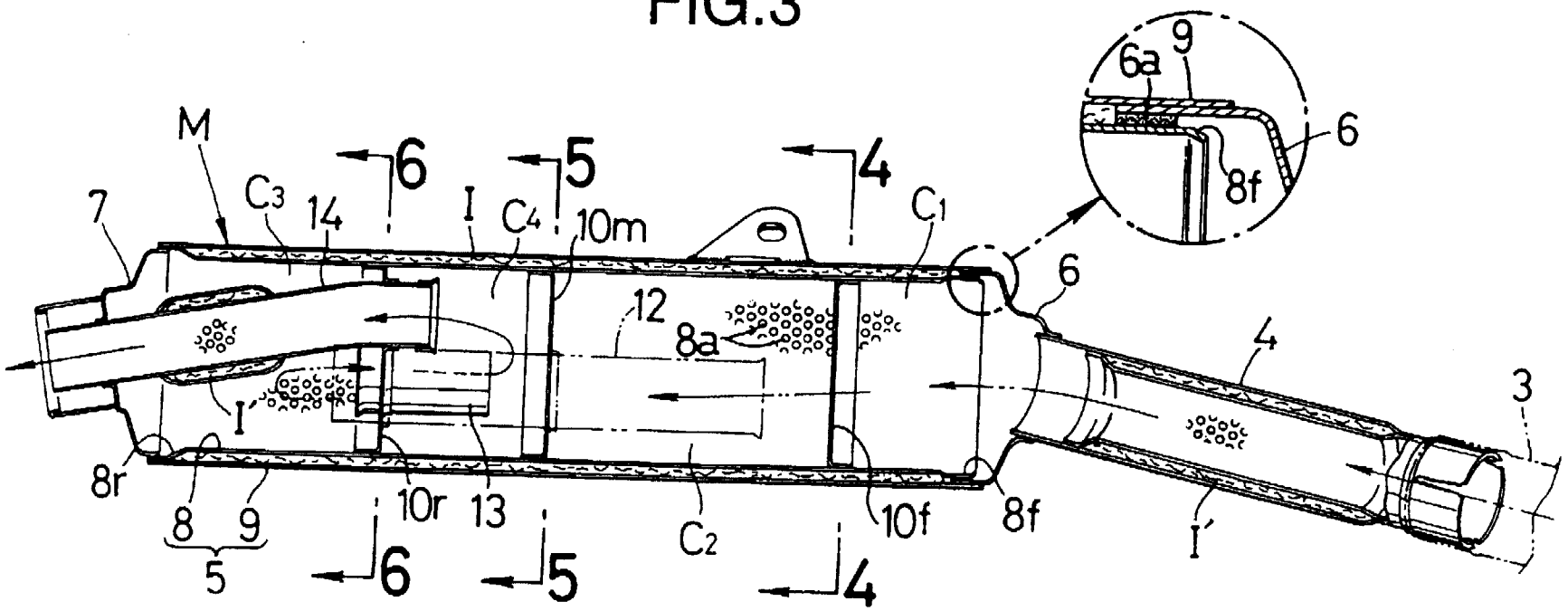
FIG. 3 is as an enlarged sectional view taken along a line 3—3 in FIG. 2.
Figure 4:
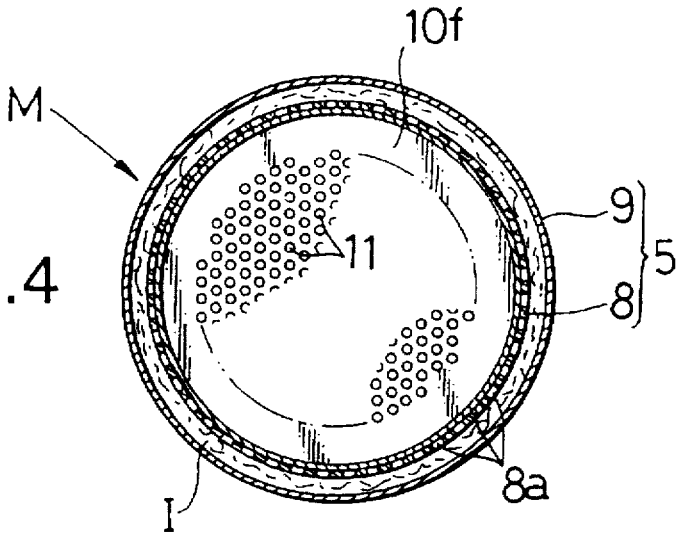
FIG. 4 is an enlarged sectional view taken along a line 4—4 in FIG. 3.
Figure 5:
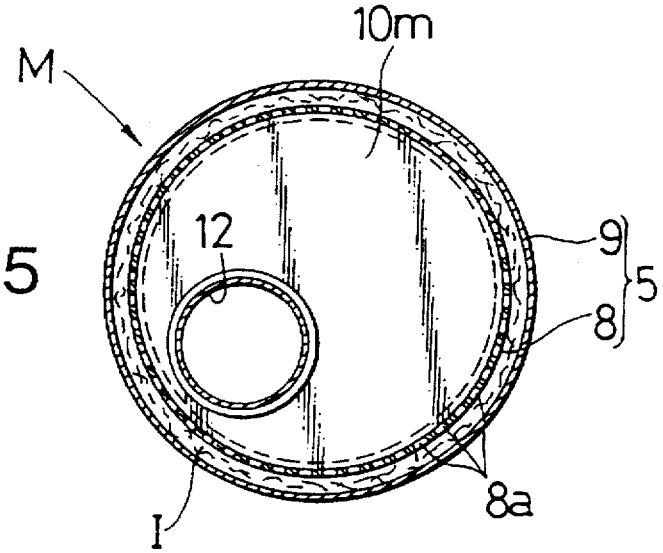
FIG. 5 is as an enlarged sectional view taken along a line 5—5 in FIG. 3.
Figure 6:
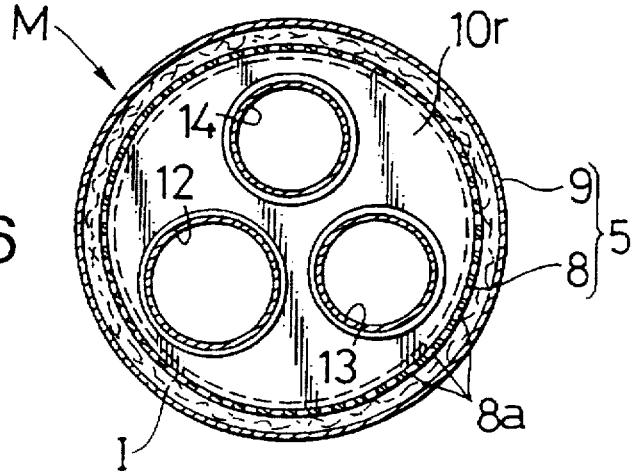
FIG. 6 is an enlarged sectional view taken along a line 6—6 in FIG. 3.

Referring first to FIGS. 1 and 2, a four-cylinder internal combustion engine E is mounted on a body frame F of a motorcycle. Four exhaust ports corresponding to cylinders are provided laterally parallel to one another and open into a front surface of an engine body 1 of the engine E. Four front exhaust pipes $2_1$, $2_2$, $2_3$ and $2_4$ are provided likewise laterally parallel to one another and connected to the exhaust ports, respectively. The front exhaust pipes $2_1$, $2_2$, $2_3$ and $2_4$ extend downwardly along the front surface of the engine body 1 and then extend rearwardly along a bottom surface of the engine body 1 and are connected to a front end of an exhaust gas collecting tube 3. A rear end of the exhaust gas collecting tube 3 is connected through a single rear exhaust pipe 4 to a front end of a silencer M which is disposed on one side of a rear wheel W and supported in place on a vehicle body.

As shown in FIGS. 3 to 6, the silencer M includes a cylindrical body 5 which opens at opposite ends (front and rear ends) thereof, and a pair of front and rear caps 6 and 7 which integrally close the front and rear open ends of the body 5, respectively. The front cap 6 is connected to a rear end of the rear exhaust pipe 4. The cylindrical body 5 is of a double-pipe structure including a porous inner pipe 8 having a large number of pores 8*a* provided in a peripheral wall thereof, and an outer pipe 9 which concentrically surrounds the porous inner pipe 8. Front and rear ends 8*f* and 8*r* of the porous inner pipe 8 are formed at a diameter larger than that of an intermediate portion thereof. Particularly, the larger diameter rear end 8*r* is welded to an inner peripheral surface of the outer pipe 9, and the larger diameter front end 8*f* is fitted into and longitudinally relatively slidably supported in a mesh spacer 6*a* which is fitted to an inner periphery of a rear end of the front cap 6.

A sound absorbing material I is incorporated in an annular clearance between the porous inner pipe 8 and the outer pipe 9 over the entire periphery thereof. The sound absorbing material I is formed of a heat-resistant fiber layer G made of glass wool or the like. The layer G is wound around an outer peripheral surface of the porous inner pipe 8 with a binder interposed therebetween, and an outer peripheral surface of the layer G is press-fitted to the inner peripheral surface of the outer pipe 9 with a predetermined interference. A procedure for molding and assembling the sound absorbing material I will be described in detail thereinafter.

Outer peripheral flange portions of front, middle and rear separator plates 10*f*, 10*m* and 10*r* are integrally fitted to the inner peripheral surface of the porous inner pipe 8 at longitudinal distances by a fixing means such as welding. By this, first, second, fourth and third exhaust gas expansion chambers $C_1$, $C_2$, $C_4$ and $C_3$ are defined in the porous inner pipe 8 in sequence from its front portion. The front separator plate 10*f* is provided with a large number of small pores 11. A long communication pipe 12 is passed through and secured to the middle and rear separator plates 10*m* and 10*r* to permit the communication between the second and third exhaust gas expansion chambers $C_2$ and $C_3$. Further, secured to the rear separator plate 10*r* are a short communication pipe 13 which permits the communication between the third and fourth exhaust gas expansion chambers $C_3$ and $C_4$, and an exhaust gas releasing pipe 14 for releasing an exhaust gas in the fourth exhaust gas expansion chamber $C_4$ to the atmosphere through an opening in the rear end of the rear cap 7.

The exhaust gases discharged into the four front exhaust pipe $2_1$, $2_2$, $2_3$ and $2_4$ corresponding to the exhaust ports in the internal combustion engine E join together in the exhaust gas collecting tube 3 and flow therefrom via the rear exhaust pipe 4 to reach the silencer M. In the silencer M, the exhaust gas is first primarily expanded in the first exhaust gas expansion chamber $C_1$, and then flows into the second exhaust gas expansion chamber $C_2$ while being contracted upon passing through each of the small pores 11 in the front separator plate 10*f*, where it is secondarily expanded. The exhaust gas further flows into the third exhaust gas expansion chamber $C_3$ while being contracted upon passing through the long communication pipe 12, where it is tertiarily expanded, and then flows into the fourth exhaust gas expansion chamber $C_4$ while being contracted upon passing through the short communication pipe 13, where it is quaternarily expanded. Then, the exhaust gas is finally discharged to the atmosphere through the exhaust gas releasing pipe 14.

In this manner, the silencer M is designed to enhance the exhaust gas sound vanish effect and satisfy an intended power performance by repeating the expansion and contraction of the exhaust gas in the course of sequential passing of the exhaust gas through the plurality of exhaust gas expansion chambers $C_1$ to $C_4$. During this time, the sound absorbing material I functions to absorb a noise generated in the course of the repetition of expansion and contraction of the exhaust gas to reduce the exhaust gas noise.

Each of the rear exhaust pipe 4 and the exhaust gas releasing pipe 14 is of a double-pipe structure, as is the cylindrical body 5 of the silencer M, and has a sound absorbing material I' of a heat-resistant fiber layer packed in each of annular clearances in the pipes 4 and 14, as is the sound absorbing material I.

The specified procedure for assembling the silencer M will be described below with reference to FIGS. 7A to 7D.

The outer pipe 9 and the porous inner pipe 8 are made independently in separate fabricating and assembling lines. Particularly, in the fabricating and assembling line for the porous inner pipe 8, the separator plates 10*f*, 10*m* and 10*r*, the long communication pipe 12, the short communication pipe 13 and the exhaust gas releasing pipe 14 are integrally assembled to the porous inner pipe 8.

Figure 7A:
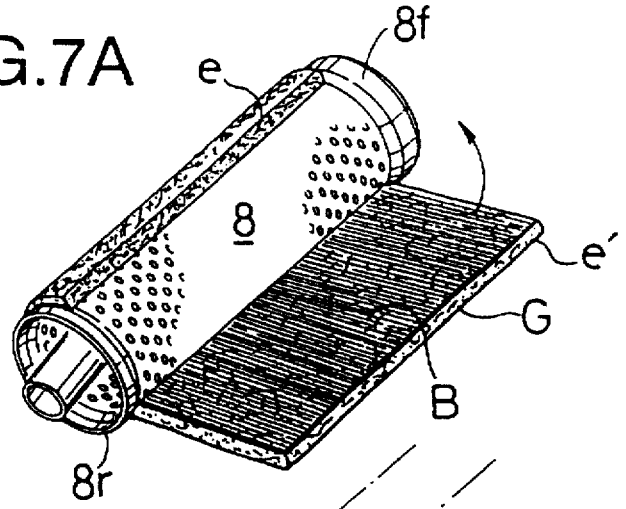
FIGS. 7A to 7D are perspective views for explaining the assembling steps.
Figure 7B:
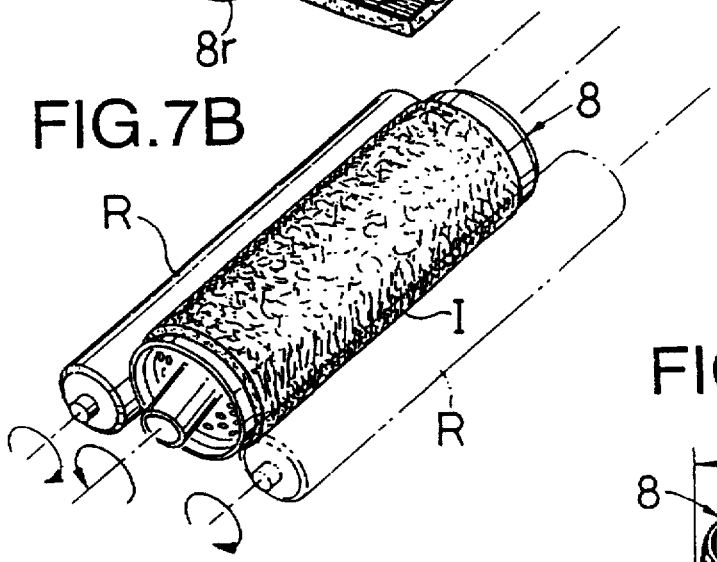

After completion of the assembling of the porous inner pipe 8, the heat-resistant fiber layer G made of glass wool or the like to which a binder B (e.g., an inorganic glass wool adhesive including kaolin and bentonite as predominant components) is applied is wound directly around the outer peripheral surface of the porous inner pipe 8, such that the binder-applied surface comes inside, as shown in FIG. 7A. Then, the porous inner pipe 8 is subjected to an ironing rolling, or calendering, using a roller R, as shown in FIG. 7B, thereby integrally forming the annular sound absorbing material I into an endless form on the outer peripheral surface of the porous inner pipe 8. The heat-resistant fiber layer G is previously formed into a predetermined shape, such that when it is wound around the outer peripheral surface of the porous inner pipe 8, the starting end e and the terminal end e' thereof are mated or opposed in close vicinity to each other. However, the starting end e and the terminal end e' of the heat-resistant fiber layer G are tightly united by the above-mentioned rolling, so that the trace of a line of juncture between both the ends e and e' disappears making the layer G into an endless annular sound absorbing material. Therefore, there is no possibility that the exhaust gas is leaked through such line of juncture. In the rolling, the thickness of the sound absorbing material I is adjusted such that the outside diameter D of the sound absorbing material I is larger than the inside diameter d of the outer pipe 9 to insure a predetermined interference (D–d) between the sound absorbing material I and the outer pipe 9.

Figure 7C:
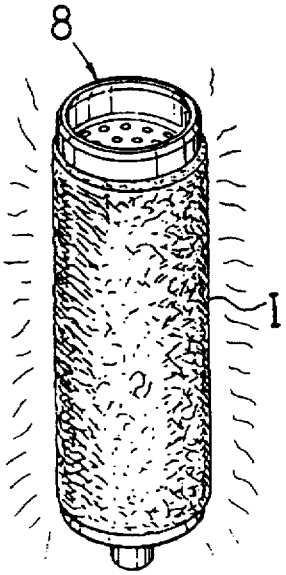

Then, the binder B is dried naturally or by heating, so as to integrally bond the sound absorbing material I to the outer peripheral surface of the porous inner pipe 8, as shown in FIG. 7C. Then, the examination of the outside diameter of the sound absorbing material I is carried out by passing the sound absorbing material I through a ring-like examiner which is not shown.

Figure 7D:
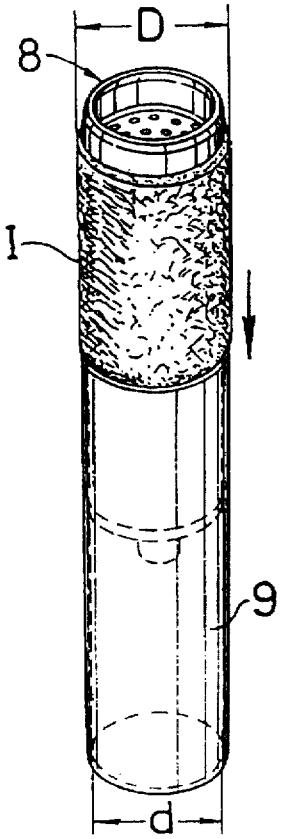

Thereafter, the inner peripheral surface of the outer pipe 9 is press-fitted to the outer peripheral surface of the sound absorbing material I, as shown in FIG. 7D, and the rear end of the outer pipe 9 and the larger diameter rear end 8*r* of the porous inner pipe 8 are integrally secured to each other by a fixing means such as welding. Further, the open rear end of the front cap 6 with the mesh spacer 6*a* previously fitted to the inner periphery thereof is press-fitted into between the inner periphery of the front end of the outer pipe 9 and the larger diameter front end of the porous inner pipe 8. The outer periphery of the front cap 6 is welded to the front end of the outer pipe 9, and the outer periphery of the rear cap 7 is welded to the rear end of the outer pipe, thus completing the assembling of the body of the silencer M.

According to the fabricating and assembling procedure, the heat-resistant fiber layer G which is to be formed into the sound absorbing material I can be wound directly around the outer peripheral surface of the porous inner pipe 8 and integrally molded thereon. Therefore, after the molding, it is not necessary to specially make a longitudinal cut for releasing the sound absorbing material from a mold, thereby preventing the leakage and short-circuiting of the exhaust gas due to the presence of the cut. Moreover, since the predetermined interference is established between the outer peripheral surface of the sound absorbing material I molded in the above manner and the inner peripheral surface of the outer pipe 9, it is possible to effectively avoid the generation of a gap permitting the leakage of the exhaust gas between both these surfaces, thereby previously preventing a reduction in sound vanish effect due to the leakage of the exhaust gas and a reduction in engine power performance.

Although the embodiment has been described as the silencer for the motorcycle, it will be understood that the present invention is also applicable to a silencer for a three-wheel vehicle or a four-wheel vehicle.

What is claimed is:

1. A process for producing a silencer, comprising winding a heat-resistant fiber layer with a binder applied thereto around an outer peripheral surface of a porous inner pipe having a peripheral wall with a large number of small pores;

calendering the heat-resistant fiber layer on the porous inner pipe including forming the heat-resistant fiber layer into an endless annular sound absorbing material on the outer peripheral surface of the porous pipe; and providing an outer pipe surrounding the porous inner pipe and the annular sound absorbing material.

2. A process for producing a silencer, comprising winding a heat-resistant fiber layer with a binder applied thereto around an outer peripheral surface of a porous inner pipe having a peripheral wall with a large number of small pores;

calendering the heat-resistant fiber layer on the porous inner pipe including forming the heat-resistant fiber layer into an endless annular sound absorbing material on the outer peripheral surface of the porous pipe and adhering the heat-resistant fiber layer on the outer peripheral surface of the porous pipe with the binder; and surrounding the porous inner pipe with an outer pipe having an annular clearance therebetween, including compressing the sound absorbing material in the annular clearance.

* * * * *